US008540039B1

(12) United States Patent
Hsiao

(10) Patent No.: US 8,540,039 B1
(45) Date of Patent: Sep. 24, 2013

(54) ACCOMMODATING STRUCTURE WITH A BELT TRANSMISSION STRUCTURE

(76) Inventor: Shu-Fen Hsiao, Taichung (TW)

( * ) Notice: Subject to any disclaimer, the term of this patent is extended or adjusted under 35 U.S.C. 154(b) by 0 days.

(21) Appl. No.: 13/455,460

(22) Filed: Apr. 25, 2012

(51) Int. Cl.
*B62D 55/00* (2006.01)

(52) U.S. Cl.
USPC ..... 180/9.1

(58) Field of Classification Search
USPC ..... 190/18 A, 115; 280/28.5, 5.22, 37, 280/47.371, 655, 5.2
See application file for complete search history.

(56) References Cited

U.S. PATENT DOCUMENTS

| | | | | |
|---|---|---|---|---|
| 4,027,889 | A * | 6/1977 | Krofchalk et al. | 280/5.22 |
| 4,044,850 | A * | 8/1977 | Winsor | 180/9.26 |
| 4,729,444 | A * | 3/1988 | Tubman | 180/9.22 |
| 4,932,677 | A * | 6/1990 | Shustack | 280/28.5 |
| 5,579,877 | A * | 12/1996 | Homayoon | 190/18 A |
| 6,938,740 | B2 * | 9/2005 | Gandy | 190/18 A |
| 7,798,886 | B1 * | 9/2010 | Williamson | 446/456 |
| 8,333,389 | B2 * | 12/2012 | Rembos et al. | 280/5.22 |
| 2004/0094378 | A1 * | 5/2004 | Gandy | 190/18 A |
| 2007/0215424 | A1 * | 9/2007 | Mittleman | 190/18 A |

* cited by examiner

*Primary Examiner* — Tashiana Adams
(74) *Attorney, Agent, or Firm* — Rosenberg, Klein & Lee

(57) ABSTRACT

An accommodating structure with a belt transmission structure. Two tracks are fixed on a body by several joining elements. Several sliding teeth are provided around the tracks. A belt is fixed at the sliding teeth along the loop structure of the tracks. The belt winds around the tracks as the sliding teeth slide.

6 Claims, 7 Drawing Sheets

ACCOMMODATING STRUCTURE WITH A BELT TRANSMISSION STRUCTURE

BACKGROUND OF THE INVENTION

1. Field of Invention

The invention relates to an accommodating structure and, in particular, to an accommodating structure with a belt transmission structure.

2. Related Art

FIG. 7 shows a conventional baggage 90. At the bottom of the baggage 90 is provided with a belt-type roller 91. When its user rolls the baggage 90, the roller 91 is in contact with the ground. When there is a hole on the ground, the roller 91 can still pass smoothly. When the user wants to walk stairs with the baggage 90 and tries to drag the baggage 90 along, the body of the baggage 90 may hit the stair corner and have damages because the roller 91 cannot get a support there. Moreover, it is more strenuous to drag in this case due to friction. Therefore, the user often lists the entire baggage 90 up before walking the stairs. This is quite inconvenient. It is an objective of the invention to solve this problem.

SUMMARY OF THE INVENTION

An objective of the invention is to provide an accommodating structure with a belt transmission structure. Such an accommodating structure can go smoothly on an uneven ground. The user can save some energy while dragging it.

To achieve the above-mentioned objective, the invention includes: a body having an accommodating space for accommodating objects; two tracks in a loop shape, each of the tracks being fixed on two opposite sides of the body by a plurality of joining elements and extending along the edges of the body to a corner for the body to be dragged along; a plurality of sliding teeth disposed on and along the loop tracks in a slideable way and exposed from the side edges of the body, with each of the sliding teeth having a roller in touch with the corresponding track; and a belt fixed at the sliding teeth along the loop track and rolling with the sliding teeth on the tracks.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
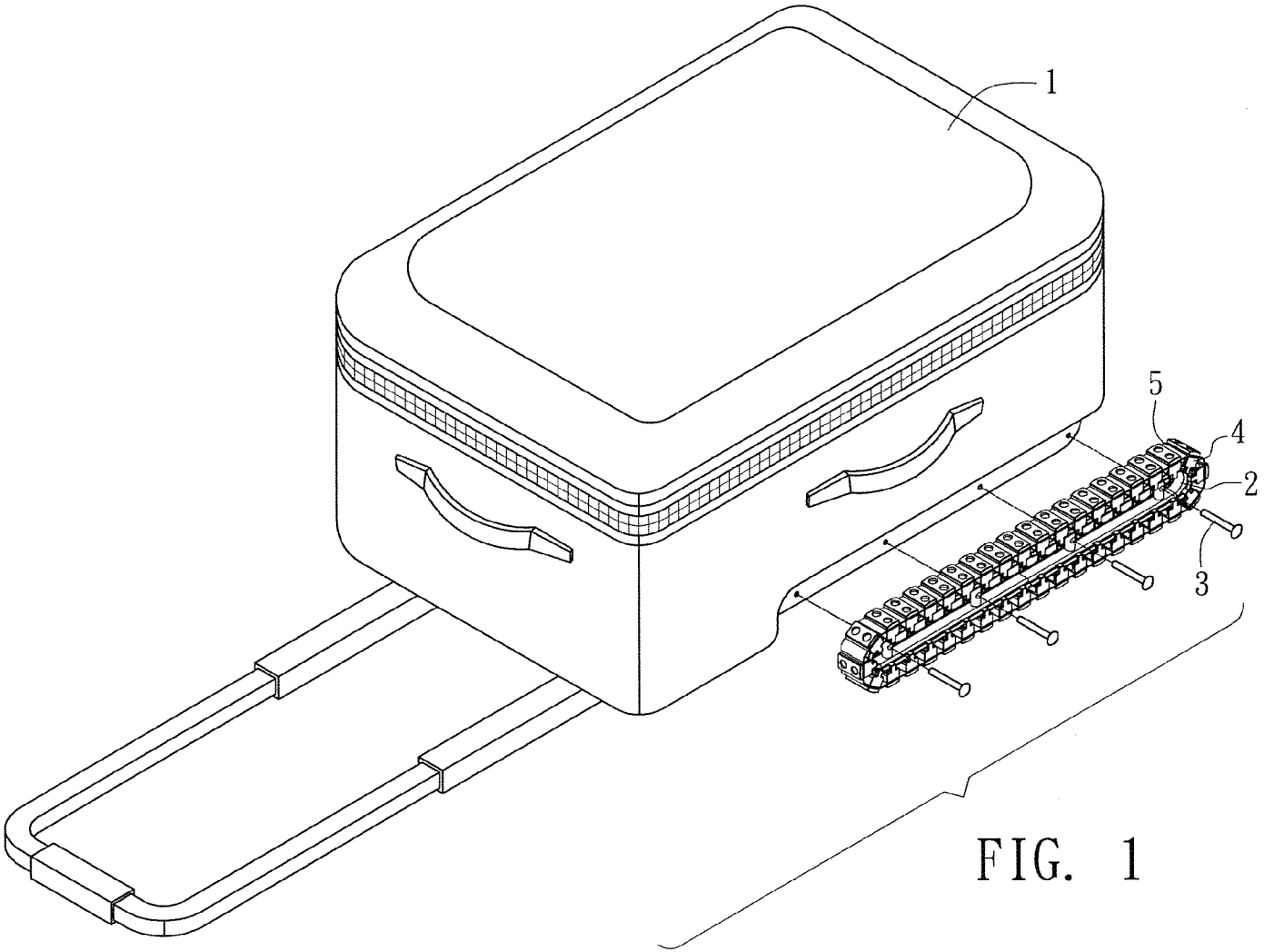
FIG. 1 is a three-dimensional perspective view of the baggage according to the first embodiment of the invention.

An embodiment of the disclosed accommodating structure with a belt transmission structure is shown in FIGS. 1 to 4. It includes a body and a belt transmission structure. The body in this embodiment is a baggage 1 that has an accommodating space (not shown) to hold objects, as shown in FIG. 1. The belt transmission structure consists of two tracks 2, several joining elements 3, several sliding teeth 4, and a belt 5.

Figure 2:
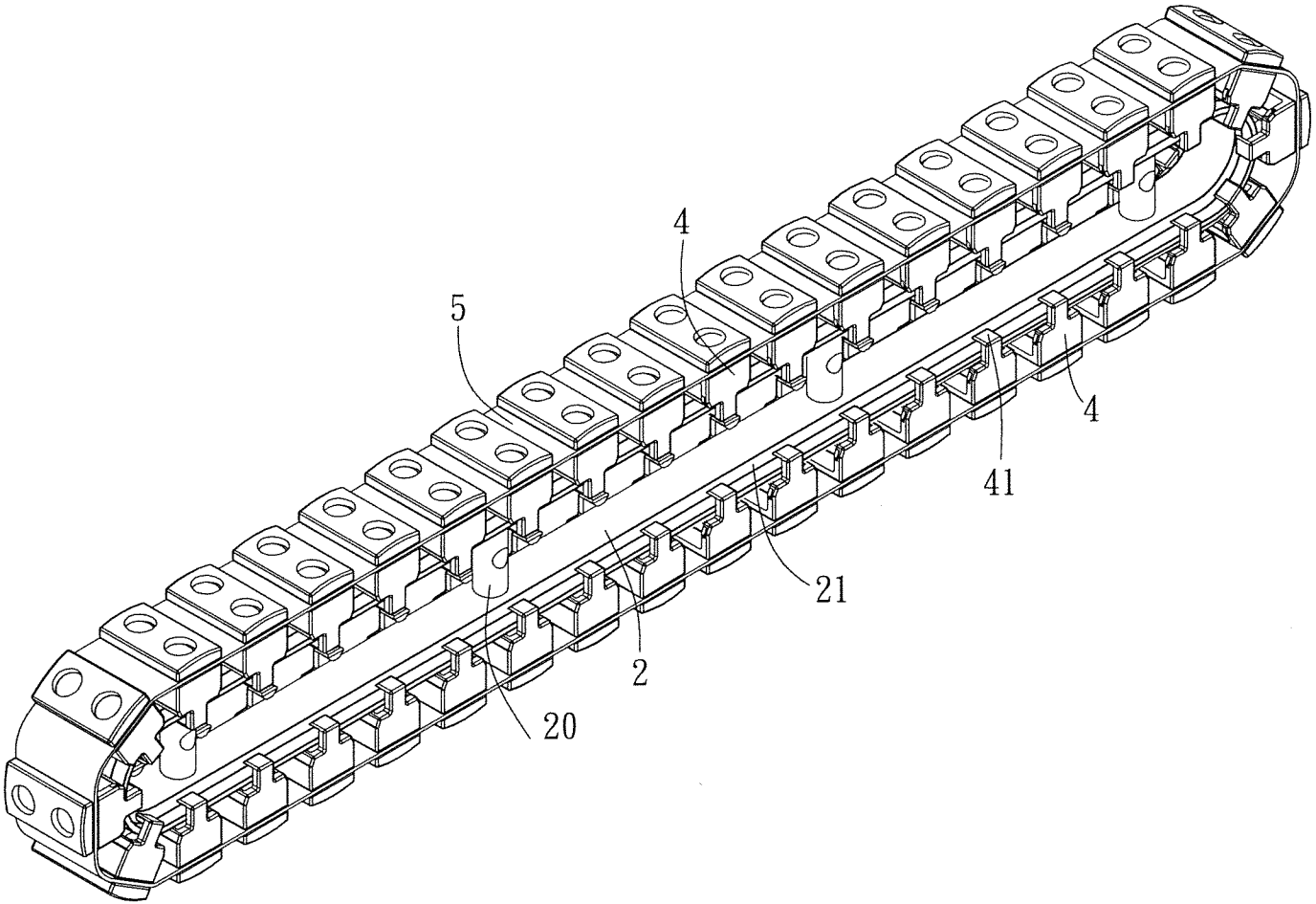
FIG. 2 is an assembly view of the belt transmission structure in the first embodiment.

As shown in FIGS. 1 and 2, each of the tracks 2 has a loop structure. The two tracks 2 are fixed to the two opposite sides of the baggage 1 by the joining elements 3. Each of the tracks 2 is located at an edge of the body 1, with one end extending to a corner where the baggage 1 is about to touch the ground. The tracks 2 in this embodiment have a loop structure with a long linear section.

As shown in FIGS. 1 and 2, the sliding teeth 4 are disposed on the tracks 2 in a slideable way along the loop structure thereof and exposed from the corners of the baggage 1. Each of the sliding teeth has a roller 40 in touch with the track as the sliding tooth slides.

As shown in FIGS. 1 to 4, the belt 5 is fixed at the sliding teeth 4 along the loop structure of the tracks 2. The belt 5 can run around the tracks 2 as the sliding teeth 4 slide. In this embodiment, each of the sliding teeth 4 has an end cap 45 on the outer side thereof to fix the belt 5.

Figure 3:
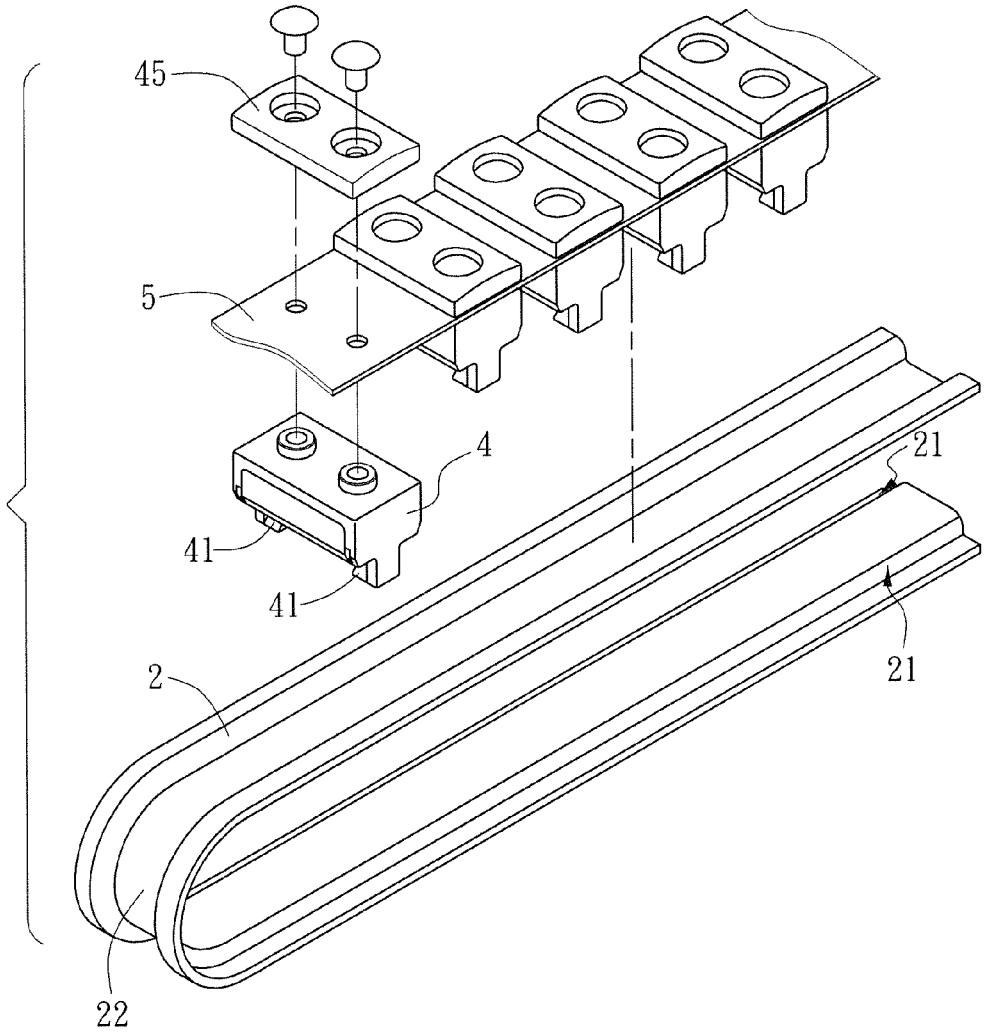
FIG. 3 is an exploded view of the belt transmission structure in the first embodiment.

As shown in FIGS. 1 to 3, each of the two tracks 2 of this embodiment has frames 20 in the loop structure. The joining elements 3 are cylindrical elements. The joining elements 3 go through the frames 20 to be fixed on the baggage 1.

As shown in FIG. 3, each of the tracks 2 in this embodiment has two engaging grooves 21 on both sides. Both sides of each of the sliding teeth 4 have two hook parts 41. Each of the sliding teeth 4 uses the two hook parts 41 to correspondingly connect to the two engaging grooves 21 of the track 2.

Figure 4:
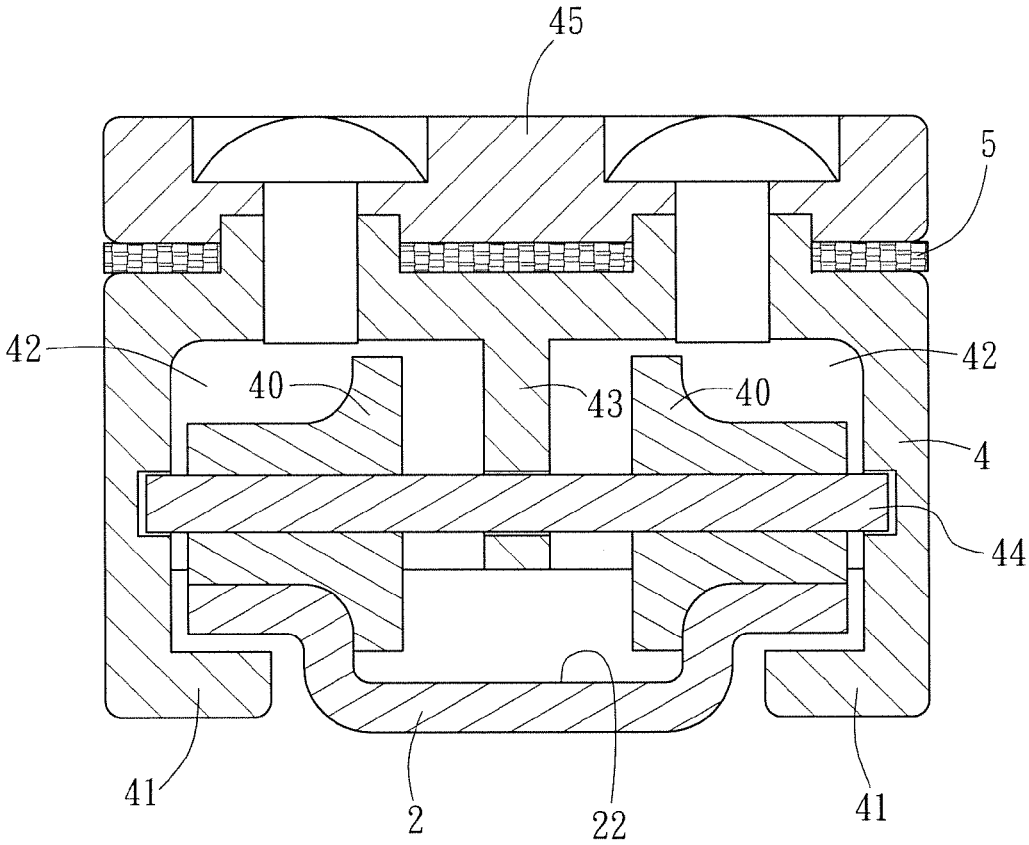
FIG. 4 is a cross-sectional view of the sliding teeth in the first embodiment.

As shown in FIG. 4, each of the sliding teeth 4 in this embodiment has two hollow parts 42 with a spacer 43 in between. An axle 44 goes through the two hollow parts 42 and the spacer 43 from both sides in each of the sliding tooth. The axle 44 inside each of the hollow parts 42 is pivotally provided with the roller 40. Each of the tracks 2 has a guiding groove 22 corresponding to the roller 40. The roller 40 rolls on the bottom of the guiding groove 22 when the corresponding sliding tooth 4 is under a force.

When one pulls the baggage 1 of this embodiment on a normal road, some of the sliding teeth 4 are in touch with the ground. As the user pulls the baggage 1, the sliding teeth 4 wind around the tracks 2, achieving the same roller effect as usual baggage 1.

Figure 5:
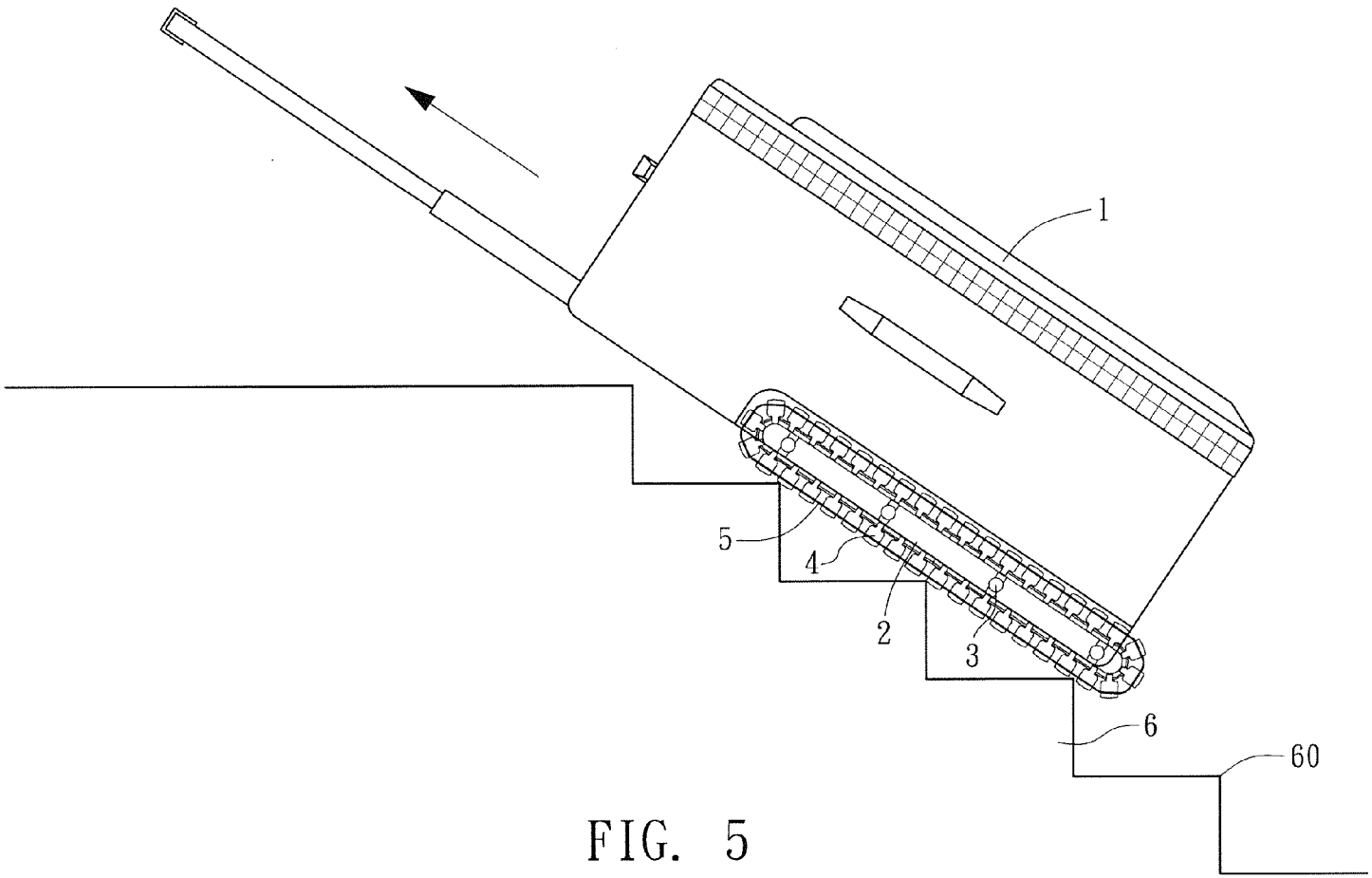
FIG. 5 is a schematic view of the baggage of the first embodiment going up stairs.

As shown in FIG. 5, to walk stairs with the disclosed baggage 1, the user can pull the baggage 1 while climbing up the stairs 6. In this case, some of the sliding teeth 4 on the tracks 2 are in contact with the right angle 60 of the stairs 6. As the baggage 1 is dragged up the stairs 6, the drop between the sliding teeth and the flexibility of the belt enable the sliding teeth 4 as the support of the baggage 1. Since the sliding teeth wind around the tracks 2, the baggage 1 is prevented from fiction due to direct contact with the stairs. Therefore, the baggage 1 can be readily dragged along as the user walks up the stairs, thus saving energy.

Figure 6:
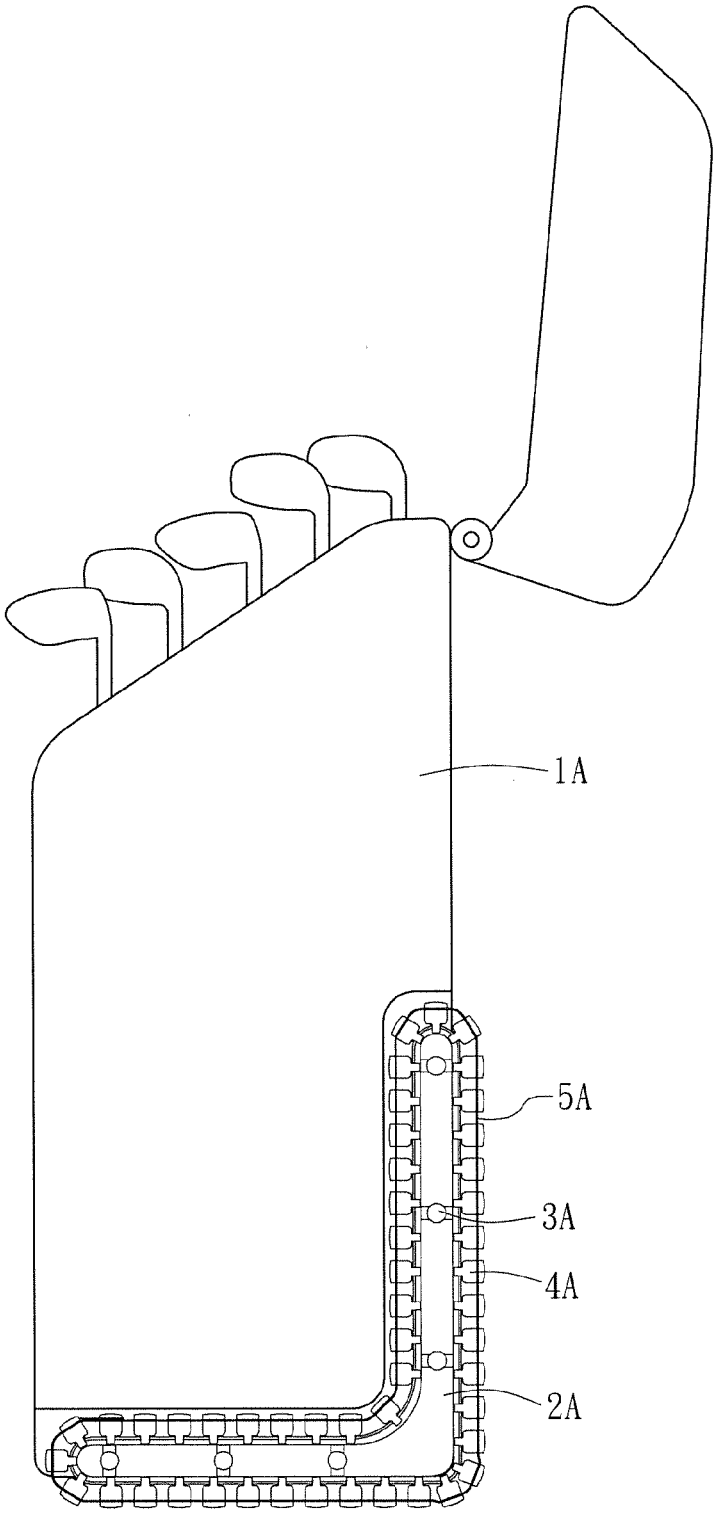
FIG. 6 is a planar view of a golf bag according to the second embodiment.
Figure 7:
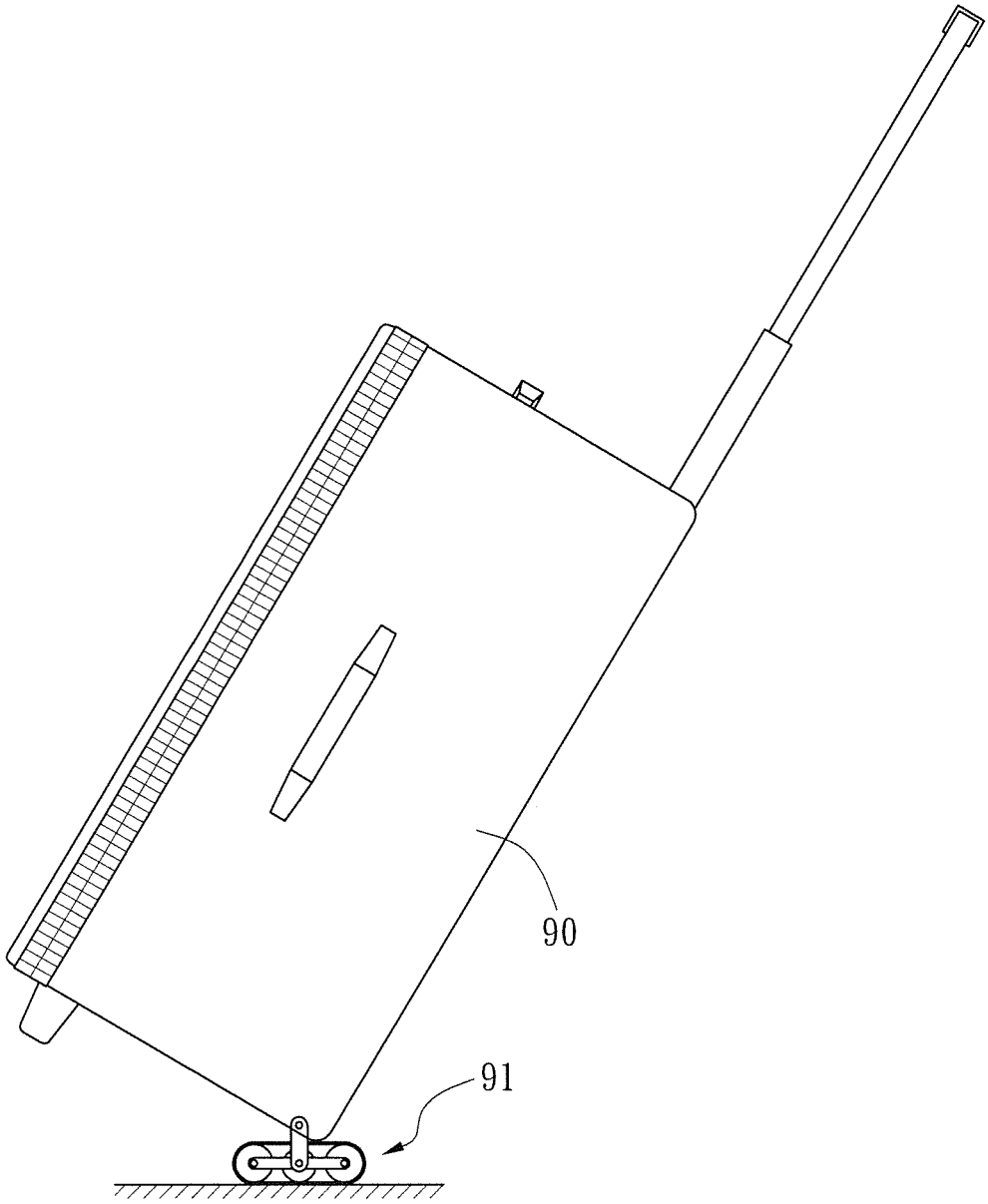
FIG. 7 PRIOR ART
FIG. 7 is a schematic view of a conventional baggage going up stairs.

Of course, the invention has many other embodiments that only differ in details. Please refer to FIG. 6 for a second embodiment of the invention. In this embodiment, the body is a golf bag 1A. The tracks 2A have a loop structure with right-angle bends. The tracks 2A are also fixed onto the gold bag 1A by several joining elements 3A. They are also provided with several sliding teeth 4A and a belt 5A to achieve the same effects as the first embodiment.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An accommodating structure with a belt transmission structure, comprising:

a body having an accommodating space for holding objects;

two tracks, each of which forms a continuous loop structure, the tracks being fixed to two opposite sides of the body and extending along the edges of the body to corners in touch with the ground;

a plurality of sliding teeth disposed along the loop structure of the tracks in a slideable way and exposed from the corners of the body, each of the sliding teeth having a roller in touch with the track as the sliding tooth slides; and a belt fixed on the sliding teeth along the loop structure of each of the tracks and winding around the track as the sliding teeth slide.

2. The accommodating structure with a belt transmission structure of claim 1, wherein the two tracks have frames in the loop structure and the joining elements are cylinders going through the frame to be fixed on the body.

3. The accommodating structure with a belt transmission structure of claim 1, wherein each of the tracks has two engaging grooves on both sides, each of the sliding teeth has two hook parts on both sides, and the two hooks correspondingly engage the two engaging grooves of the track.

4. The accommodating structure with a belt transmission structure of claim 1, wherein each of the sliding teeth has two hollow parts with a spacer in between, an axle goes from both side inside the sliding tooth through the two hollow parts and the spacer, the axle in the hollow parts is pivotally mounted with the roller, each of the tracks has a guiding groove for the corresponding roller, and the roller rolls on the bottom of the guiding groove when the sliding tooth is under a force.

5. The accommodating structure with a belt transmission structure of claim 1, wherein each of the sliding teeth uses an end cap on the outer side to fix the corresponding belt.

6. The accommodating structure with a belt transmission structure of claim 1, wherein the accommodating unit is a baggage or a golf bag.

* * * * *